United States Patent [19]

Green

[11] Patent Number: 5,044,185

[45] Date of Patent: Sep. 3, 1991

[54] BYPASS KEY SYSTEM AND METHODS

[76] Inventor: James R. Green, 111 Bridgers Ave., Auburndale, Fla. 33823

[21] Appl. No.: 610,143

[22] Filed: Nov. 7, 1990

[51] Int. Cl.[5] ..... E05B 9/04

[52] U.S. Cl. ..... 70/368; 70/371

[58] Field of Search ..... 70/371, 368, 367, 369

[56] References Cited

U.S. PATENT DOCUMENTS

| | | | |
|---|---|---|---|
| Re. 17,936 | 1/1931 | Shinn | 70/368 |
| 2,480,026 | 8/1949 | Jacobi | 70/368 |
| 3,434,316 | 3/1969 | Neary | 70/371 |
| 3,526,111 | 9/1970 | Jacobi | 70/368 |

*Primary Examiner*—Robert L. Wolfe

*Attorney, Agent, or Firm*—Edward M. Livingston

[57] ABSTRACT

To provide lock servicing of particular door locks in common use, a bypass key (1) with key blade (2) long enough to reach through a lock-cylinder plug (26 and 45) and low enough to pass under extended tumblers (37) of a lock cylinder (28 and 43) in order to dislodge a tailpiece (36) from a stop-washer (63 and 45) or other attachment means at an inside end of the plug is provided in conjunction with a control key (14 and 21) with a key blade (13) of the same length into which single-lock and multiple-lock profiles (15) can be made to rotate the lock plug (26 and 45) and disengage or engage a lock cylinder (28 and 43) and its means of attachment to a door lock (54). Methods are provided for using the bypass keys (1, 1A, 18, 22 and 23) in conjunction with the control key (14 and 21) for unlocking a door (55) and installing a new or changed lock cylinder (28 and 43) without removing the lock (54) from the door (55), a time-consuming process that is required in current lock-change methods, regardless of whether or not a key for the lock is available.

16 Claims, 5 Drawing Sheets

BYPASS KEY SYSTEM AND METHODS

BACKGROUND OF THE INVENTION

This invention relates to key blanks and more particularly to bypass keys and methods for using the bypass keys to change locks and to service particular types of door locks without removing the locks from the doors.

Previously in the lock-service industry, it has been necessary for locksmiths to remove entire locks from doors in order to change locks and otherwise to service most of the more widely-used door locks. In some of the currently popular door locks, there are inside keyless lock mechanisms referred to commonly as entry locks. They allow the door to be locked from one side, such as within a building or a room, without a key but require a key for unlocking the door from the opposite side or from outside the room or building. When a key has been lost or stolen, or when there is a new user of a lock, a particular user of the lock may want to prevent others who may have keys to the lock from unlocking or using it. This requires servicing of the lock by changing or replacing the lock cylinder to use a different key.

SUMMARY OF THE INVENTION

One object of this invention is to make it possible to remove a lock cylinder from a door without removing the entire door lock when a key has been lost or forgotten or for other reasons is not reasonably available.

Another object of this invention is to make it possible to install a new or a changed lock cylinder into a door without removing the lock from the door when a key to the lock is not readily available.

A further object of this invention is to make it possible when a key to a lock is available to install a new or changed lock cylinder in a door without removing the lock from the door.

Still another object of this invention, needed particularly for use in business establishments, apartments, hotels and condominiums, is to make it possible to install new or changed locks to a plurality of similar doors with similar locks whenever desired without removing the locks from the doors, regardless of whether or not a key is reasonably available.

The present invention accomplishes the above and other objects by providing lock servicing of particular door locks in common use, a bypass key with a key blade long enough to reach through a lock-cylinder plug and low enough to pass under extended tumblers of a lock cylinder in order to dislodge a lock shaft from a lock-ring or other attachment means at an inside end of the plug is provided in conjunction with a control key blank with a key blade of the same length into which single-lock and multiple-lock profiles can be made to rotate the lock plug and disengage or engage a lock cylinder and its means of attachment to a door lock. Methods are provided for using the bypass key in conjunction with the control key blank for unlocking a door, removing a lock cylinder from the door and installing a new or changed lock cylinder without removing the lock from the door, regardless of whether or not a key for the lock is available.

BRIEF DESCRIPTION OF THE DRAWINGS

This invention is described by claims in relation to a description of preferred embodiments illustrated in the following drawings in which:

DESCRIPTION OF THE PREFERRED EMBODIMENTS

Figure 1:
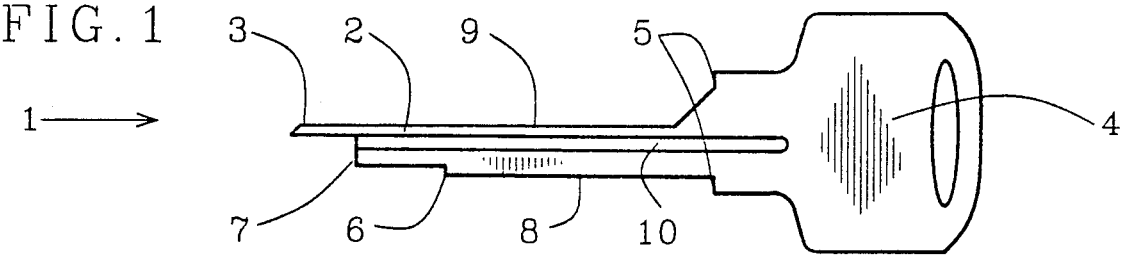
FIG. 1 is a side view of a double-ward-cut bypass key before alteration of a blade tip for contacting a lock tailpiece.

Referring to FIG. 1, a bypass key 1 with a bypass key blade 2 is extended to a straight bypass-key tip 3 from a key bow 4 having selectively cut and positioned key shoulders 5. A base ward cut 6 and a tip ward cut 7 are provided in the vicinity of the tip 3 of a blade bottom 8. A flat bypass blade top 9, generally positioned slightly above a key groove 10, is low enough to pass under extended tumblers of a lock.

A series of bypass keys with double ward cuts 6 and 7 are provided for door locks with lock cylinders that are relatively long.

Figure 2:
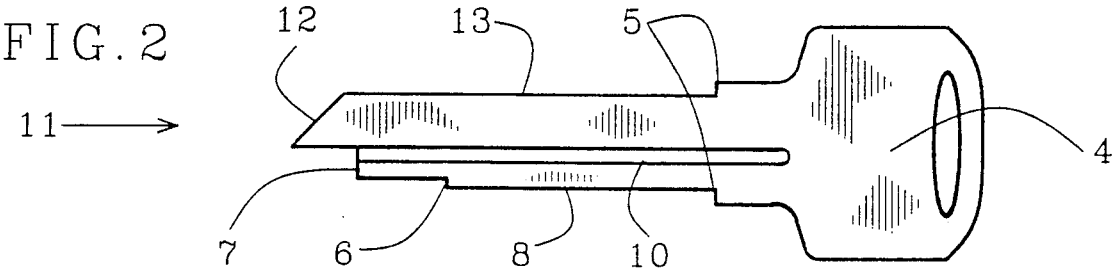
FIG. 2 is a side view of a double-ward-cut control key blank.

Referring to FIG. 2, a control key blank 11, the same length as the bypass key 1, is extended to a blank control key tip 12 from the key bow 4. A control key top 13 is the same height as a standard conventional key blank for a particular series of locks which either are sized and shaped to fit. Different from a conventional key blank, however, a control key blank 11 is provided with ward cuts 6 and 7 the same as the bypass key 1 and it is long enough to reach engagement and disengagement components of locks as described in relation to this invention.

Figure 3:
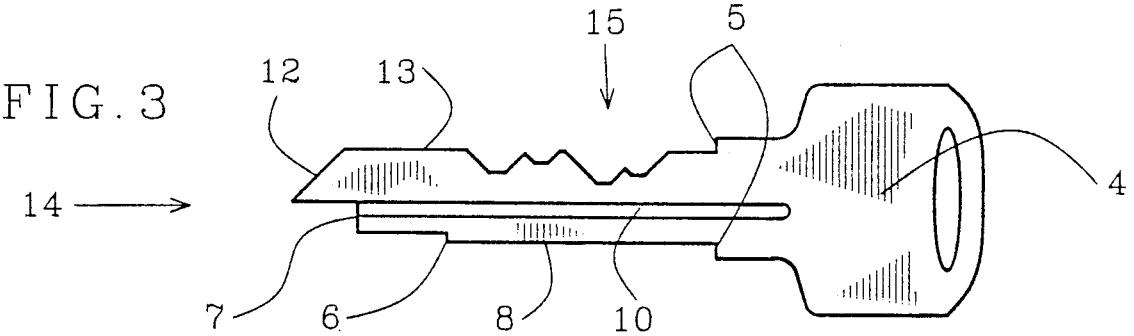
FIG. 3 is a side view of a double-ward-cut control key that has been profiled for a particular lock and plurality of locks.

Referring to FIG. 3, a control key 14 is in the form of a control key blank 11 that is provided with a top profile 15 which can be designed for a single lock or for a series of locks.

Figure 4:
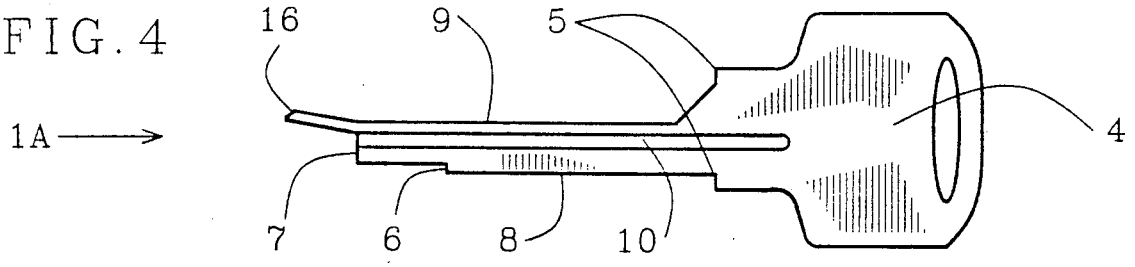
FIG. 4 is a side view of a double-ward-cut bypass key with a blade tip extended selectively upward for contacting a lock tailpiece.

Referring to FIG. 4, an upwardly-extended tip 16 can be provided on a bypass key 1 for aiding contact with locking components of a lock as described hereafter.

Figure 5:
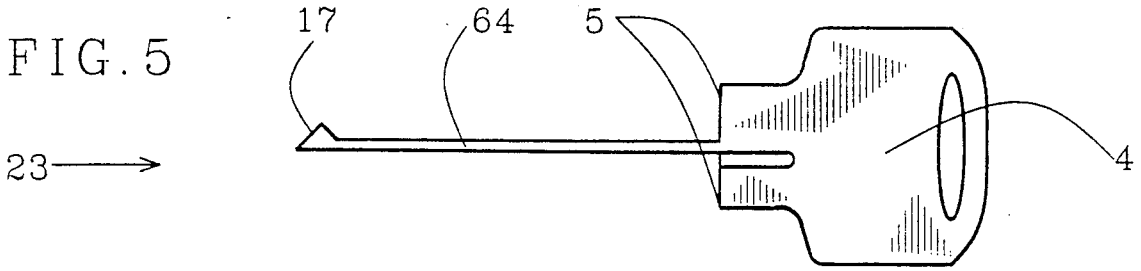
FIG. 5 is a side view of a tumbler raiser tool with key bow having a tumbler-raiser peak at the blade tip.

Referring to FIG. 5, a tumbler-raiser tool 23 which is to be used in the opening procedure with the bypass keys is shown.

Figure 6:
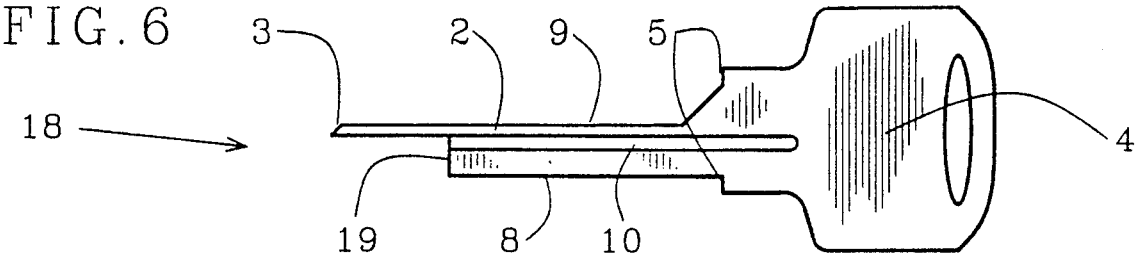
FIG. 6 is a side view of a single-ward-cut bypass key before alteration of a blade tip for contacting a lock tailpiece.

Referring to FIG. 6, a single-ward-cut bypass key 18 is generally shorter than the bypass key 1 because it is used for shorter lock plugs and requires only a single ward cut 19. However, it can be longer or as long as double-ward-cut keys for larger lock cylinders or for lock cylinders with more tumblers. For the single-ward-cut bypass key 18, there is only one or one group of obstacles for which a ward cut is required. Also, the tip 3 is shorter such that it does not require two ward cuts for the rigidity and material strength of the same tip 3 used on bypass key 1 shown in FIG. 1.

Figure 7:
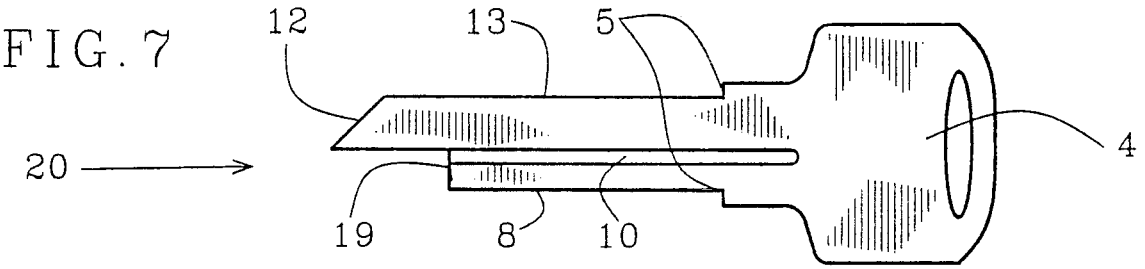
FIG. 7 is a side view of a single-ward-cut control-key blank.
Figure 8:
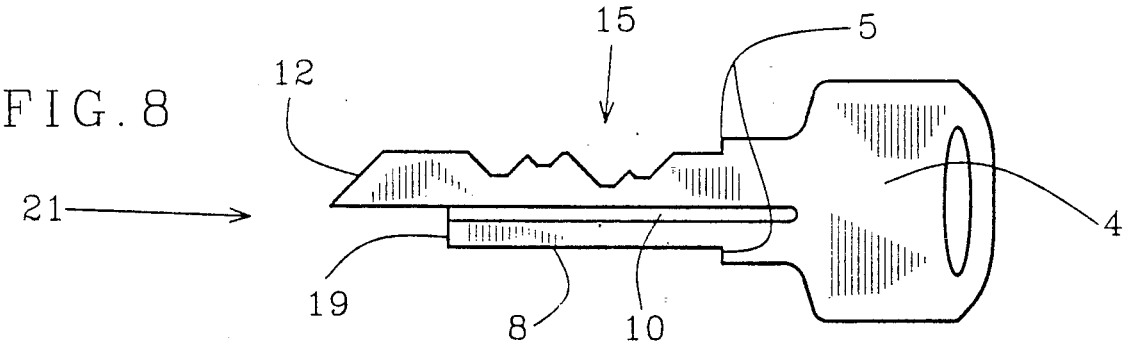
FIG. 8 is a side view of a single-ward-cut control key that has been profiled for a particular lock and plurality of locks.
Figure 9:
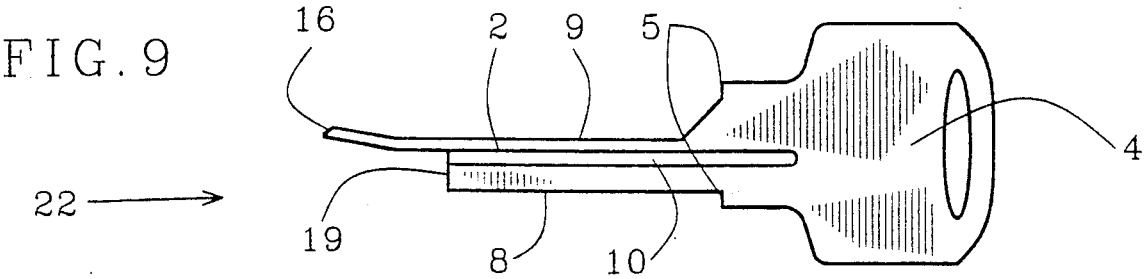
FIG. 9 is a side view of a single-ward-cut bypass key with a blade tip extended selectively upward for contacting a lock tailpiece.

Referring to FIGS. 7–9, a single-ward cut 19 is provided for single-ward-cut control key blank 20, for single-ward-cut control key 21 and for single-ward-cut bypass key 22. Exclusive of shorter distances from shoulders to tips 12 and 16, and other features of this portion of the bypass key system are the same as for corresponding double-ward-cut keys for use with locks for which either may be sized and shaped to fit.

Figure 10:
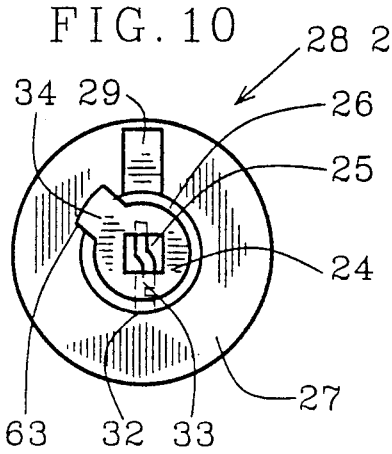
FIG. 10 is a rear view of a lock-cylinder assembly showing in particular a cylinder stop piece with an angular orifice through which a bypass-key blade is employed to dislodge a lock tailpiece.

Referring to FIG. 10, a stop washer groove 24 with a cylinder stop aperture 25 is part of a lock-cylinder attachment means at an inward end of cylinder plug 26 which is rotatable in a cylinder face plate 27 in this rear view of a lock-cylinder assembly 28. Projecting vertically from the cylinder face plate 27 is a cylinder housing 29. It is an object of this invention to dislodge a locking member from the cylinder stop aperture 25 in locks which utilize this stop washer groove 24 as part of a means of attachment between a lock and a lock cylinder and as part of a locking means for various types of locks.

Figure 11:
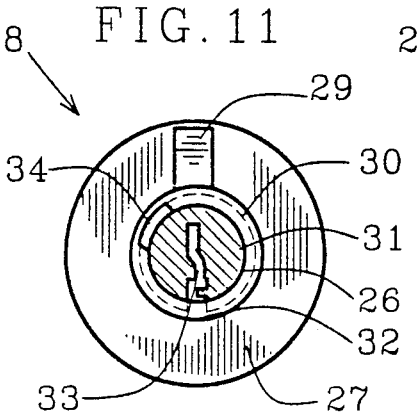
FIG. 11 is a rear view of a lock-cylinder assembly at a housing retainer-ring section showing in particular a retainer inside diameter through which bypass keys must pass to reach a rear dislodgment section of a lock cylinder.

Referring to FIG. 11, a plug retainer ring 30 has a plug retainer ring groove 31 which is slightly inward from a keyway bottom 32 of a keyway 33 in the cylinder plug 26. It is to allow bypass keys 1, 1A, 11, 14, 18, 20, 21 and 22 to be inserted beyond this retainer ring 30 that a base ward cut 6 or a single ward cut 19 are provided. The keyway 33 is a form of channel which terminates at the cylinder face plate 27, such that the keyway bottom 32 is at an inside wall of cylinder face plate 27.

Figure 12:
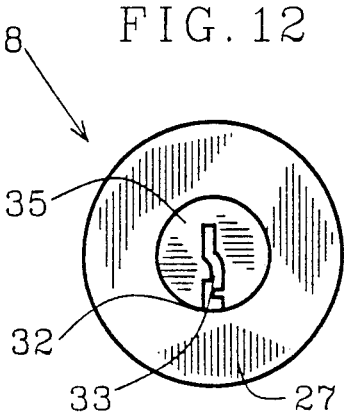
FIG. 12 is a front view of a lock-cylinder assembly illustrating in particular a keyway at a key-entry face of lock-cylinder plug.

Now referring to FIG. 12 with reference to FIGS. 10 and 11, a cylinder plug face 35 at a front of lock-cylinder assembly 28 rotates inside of cylinder face plate 27 by rotation of a key in the keyway 33 when cylinder housing 29 is positioned with transverse motion arrested. Rotation of the cylinder plug 26 with a suitably profiled control key 14 or 21 and resulting rotation of a cylinder stop piece 34 allows engagement or disengagement of the lock-cylinder assembly and the lock in accordance with procedural steps described in this invention.

Figure 13:
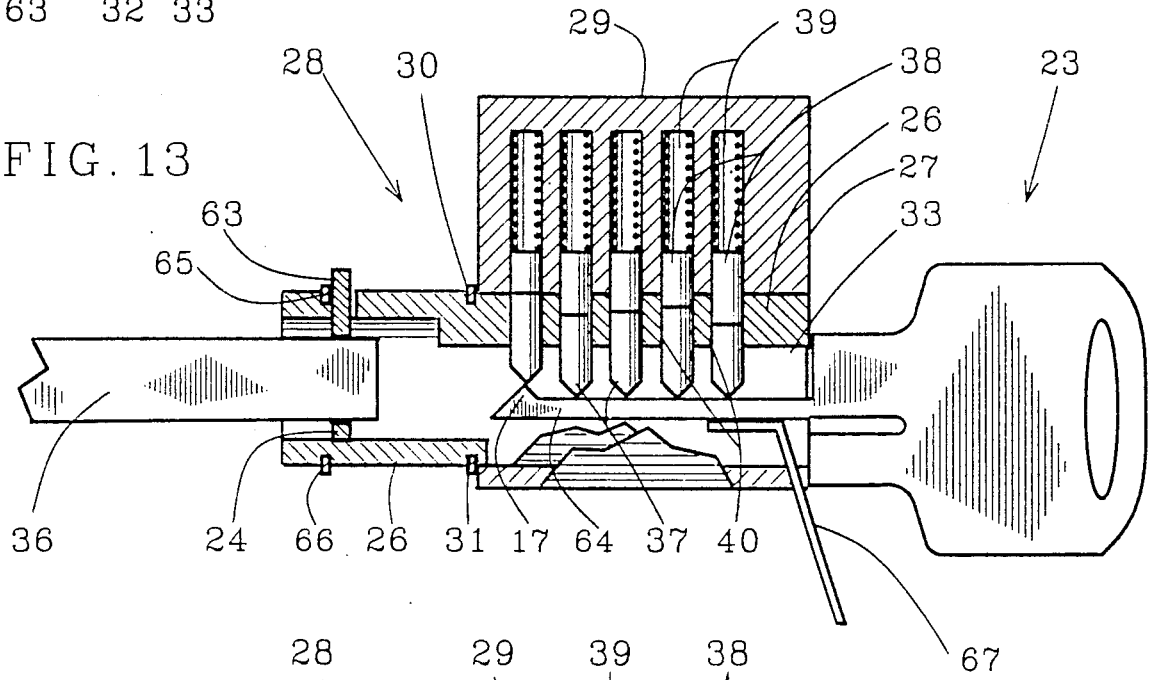
FIG. 13 is a cutaway side view of a lock cylinder with a tumbler raiser tool having a tumbler-raiser peak at a tip of the blade inserted under the spring-loaded housing chambers and unsprung tumblers in a lock plug to raise the tumblers individually to a shear line, thereby allowing rotation of a cylinder plug with the help of a separate tool inserted at a keyway bottom in front of the plug.

In FIG. 13, a tumbler raiser tool 23 with a tumbler-raiser tip 17 is inserted into a keyway 33 of a cylinder plug 26. The plug 26 is rotatable in a cylinder housing 29. In this cutaway side view, the plug retainer ring 30 is illustrated in a position to prevent outward travel of the plug 26 from the housing 27. In conjunction with use of a tension tool 67, commonly called a pick tool, the handle tailpiece 36 may be rotated. The handle tailpiece 36 normally is prevented from rotation by lock features not a part of this invention when it is positioned in the stop washer groove 24, thus preventing rotation of the cylinder from rotating an attachment means in the lock and from rotating the lock-cylinder assembly 28 to an engagement or disengagement relationship circumferentially in particular locks. In other locks, the attachment means is constructed differently but operates similarly in relation to this invention. Some features of locks not a part of this invention are illustrated to demonstrate a working relationship of parts of this invention to locks in which it is operable.

It is illustrated further in FIG. 13 that tumbler raiser blade 64 can pass under bottom pins 37 when the tip 17 is inserted to a position of contact with bottom pins 37. Not part of this invention but functioning in relationship to it are spring-loaded top pins 38 extending from spring-loaded tumbler chambers 39 in cylinder housing 29 into chamber wall 40 to prevent rotation of the cylinder plug 26 in cylinder housing 29.

Figure 14:
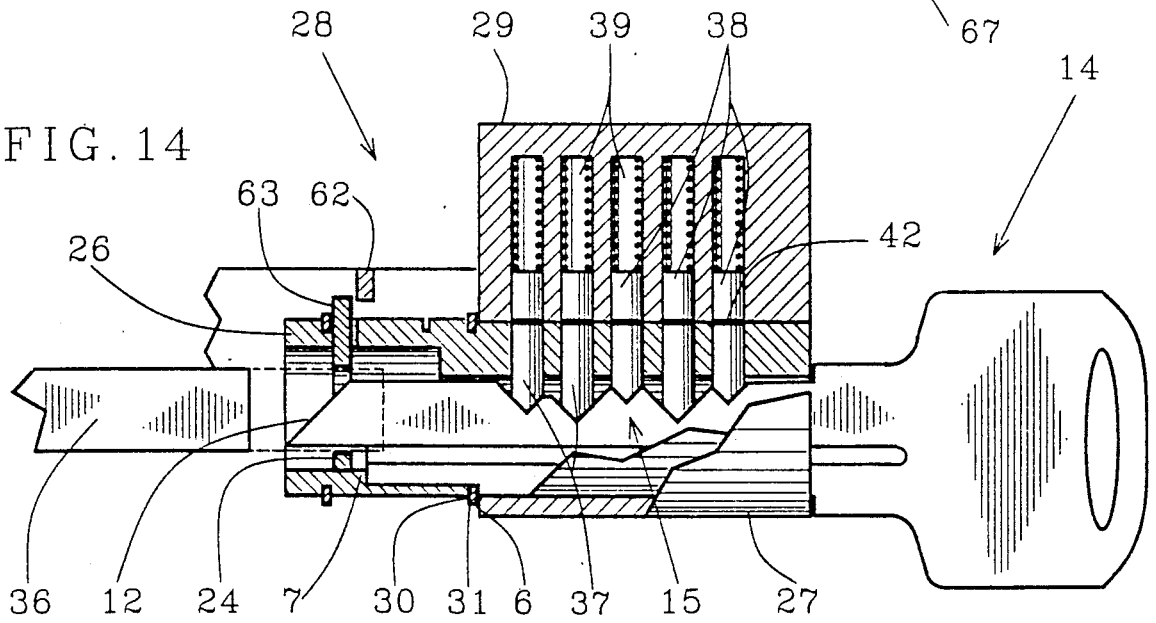
FIG. 14 is a cutaway side view of a lock cylinder with a double-ward-cut control key in a position in which the bottom pins have been employed to raise the top pin tumblers to a line of contact of the plug and the housing (that is, the shear line) in order to allow rotation of the plug to operate the lock cylinder.
Figure 15:
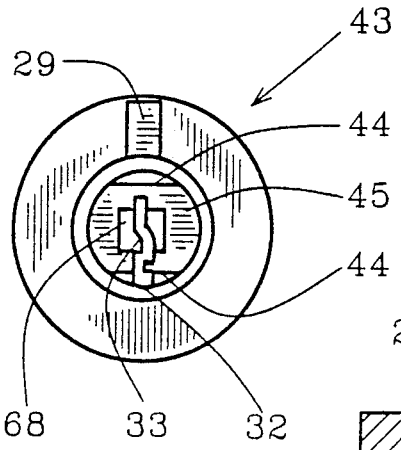
FIG. 15 is a rear view of a lock-cylinder assembly at a lock ring with an angular orifice through which a bypass-key blade is inserted to dislodge a lock tailpiece short variety of door locks for which single-ward-cut bypass keys are employed.

Referring to FIG. 14, a control key 14 with ward cuts 6 and 7 and top profile 15 is inserted into keyway 33 to dislodgment contact with tailpiece 36. Different from insertion of bypass key 1, however, insertion of control key 14 positions the top profile 15 under bottom pins 41 which raise spring-loaded top pins 38 to a rotational line of contact (shear line) 42 of the plug 26 and the housing 29 to allow rotation of plug 26 and resulting operation of lock cylinder assembly 28. Rotation of the plug 26 with the tail piece 36 dislodged from stop washer groove 24 allows rotation of the cylinder stop piece 34 in FIGS. 10 and 11. When a control key 14 has been constructed for a particular lock or series of locks, then the bypass key 1 is not required. However, in servicing locks for which there is no key available as a pattern for copying a top profile 15 onto a control key blank 11 to for a control key 14, use of bypass key 1 is essential to this bypass key system.

Extended bottom pins 37, mentioned in relation to FIG. 13 and described further with reference to FIG. 14 above, are plug bottom pins 41 and spring-loaded top pins 38 which are in combined locking position.

Referring to FIGS. 15–18, a short-plug cylinder assembly 43 is illustrated in rear and side views in relationship to a single ward-cut bypass key 22 and control key 21. Form a front view, lock cylinder assemblies 28 and 43 are sufficiently the same that a front view of lock cylinder 43 is not shown. The rear sections are different, however, in ways that require different types of ward cuts and different lengths of keys generally.

Referring to FIGS. 15–18 and 21, flats 44 on single-ward-cut plug 45 are slidable through attachment orifice 46 in door-lock handle 47 when plug 45 is rotated to the same angle of rotation as attachment orifice 46. After plug 45 is inserted through orifice 46, plug 45 is then rotated to where opposite walls 48 of attachment orifice 46 are not at the same angle as the flats 44 in plug 45. This difference of angle of rotation causes a retainer wall 49 in lock base 50 to enter a retainer channel 51 at the base of flats 44 to secure lock base 50 to plug 45 and thus retain the lock cylinder 43 in single-ward-cut door-lock handle 47. Tumbler housing 29, extended from cylinder 43, is inserted into a housing channel 52 in a housing guide 53 which is attached to the lock base 50 to prevent housing 29 and the lock cylinder from which it extends from rotating when a key is rotated in the lock plug 45. When a conventional key is used, the lock rod 36 prevents the plug 45 from rotating to a position where the flats 44 are in line with opposite walls 48 of attachment orifice 46 and the lock cylinder 43 remains attached to lock base 50. However, when keys are made according to this invention are used, the lock rod 36 is dislodged and the plug 45 is allowed to rotate to where it can be removed from or installed in the lock handle 47. The lock components referenced are not part of this invention. However, they demonstrate how this invention is related to the lock components.

Figure 16:
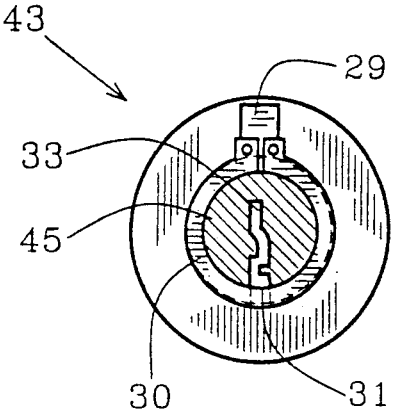
FIG. 16 is a rear view of a lock-cylinder assembly at a housing retainer-ring section showing in particular a retainer-ring inside diameter through which bypass keys must pass to reach a rear dislodgment section of a short variety of lock cylinders for which single-ward-cut bypass keys are employed.
Figure 17:
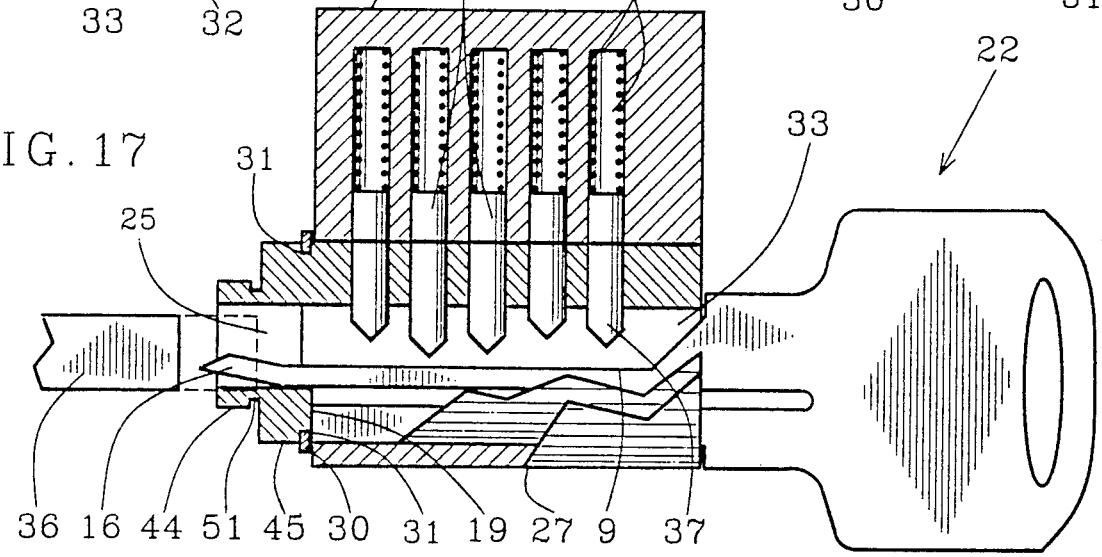
FIG. 17 is a cutaway side view of a lock cylinder, after a tumbler raiser tool was used to raise bottom pins to shear line to turn cylinder plug, with a single-ward-cut bypass key with upwardly extended tip inserted under spring-loaded tumblers in a short variety of lock plugs.
Figure 18:
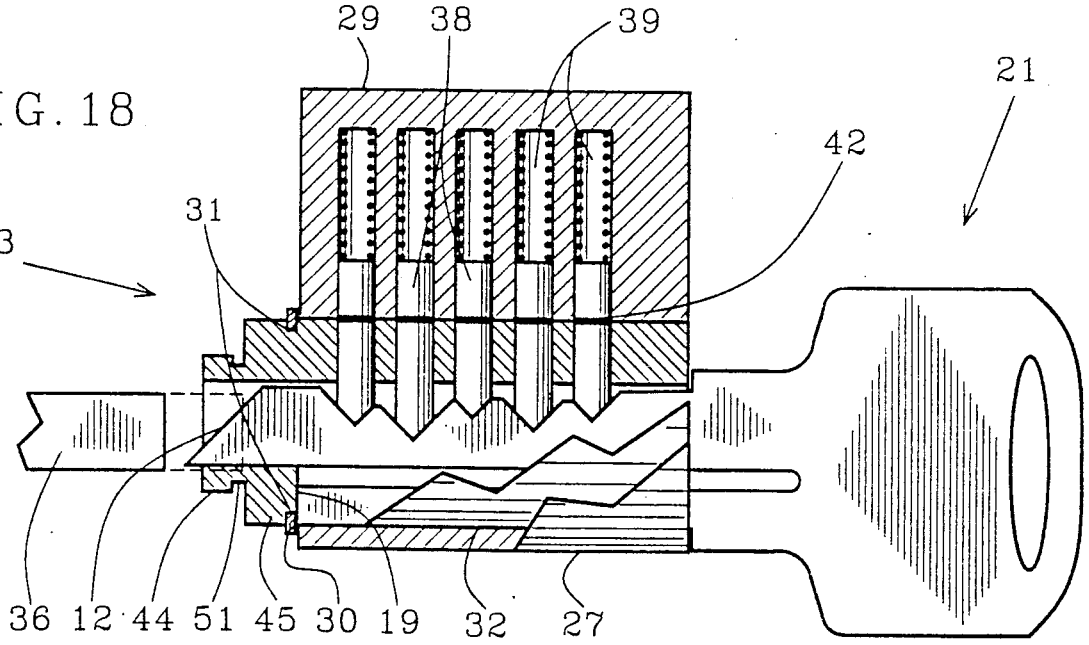
FIG. 18 is a cutaway side view of a lock cylinder with a single-ward-cut control key in a position in which the control key has been used to raise spring-loaded tumblers to a line of contact of the plug and the housing (that is, the shear line) to allow rotation of a short variety of lock plugs to operate the lock cylinder.

In FIG. 16, a plug retainer ring 30 serves the same function in relation to plug 45 as to plug 26 in FIGS. 10–14. There is a longer distance from the retainer ring 30 to a position of contact of the key 23 with a tailpiece 36. The orifices in differently-shaped plugs may be different in size also. These differences account for the single ward cut 19 in this bypass key system for different types of locks in which this invention is used.

Figure 19:
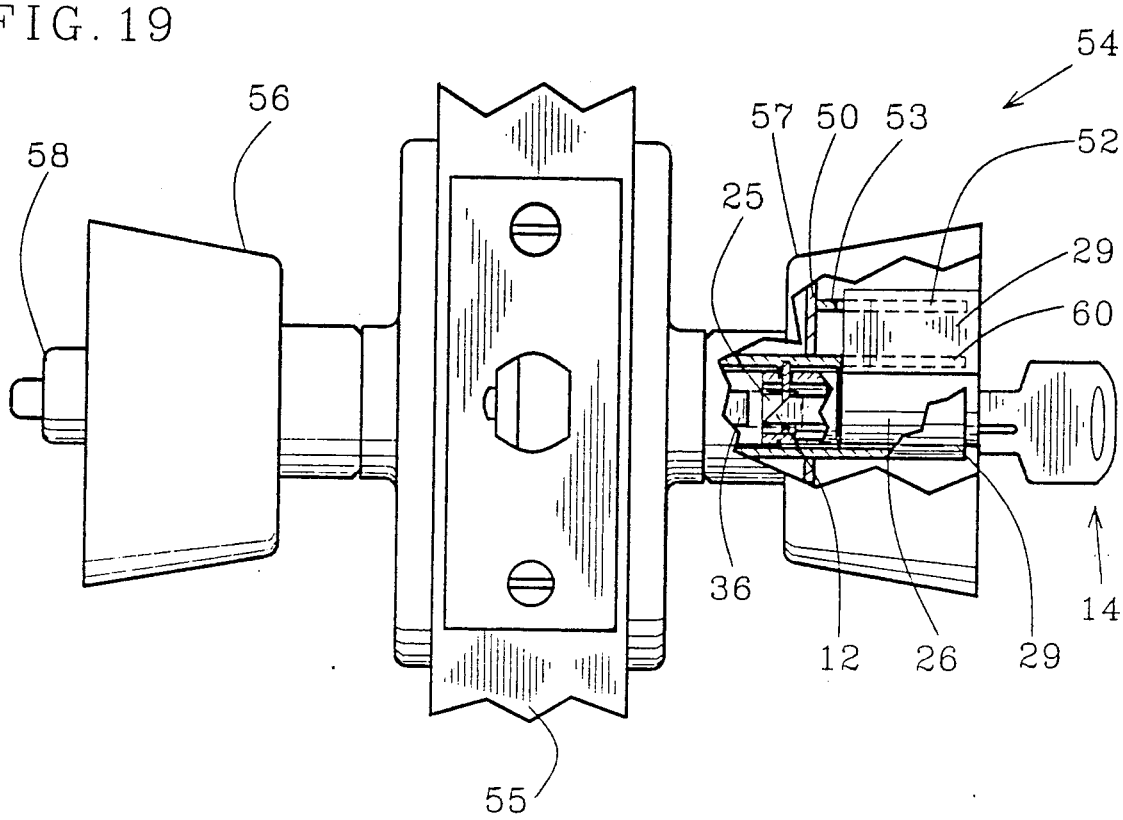
FIG. 19 is a partial front cutaway view of door lock with a keyless inside lock in a door handle at the left side and a lock cylinder with a control key in operative position in an outside door handle at the right side.
Figure 20:
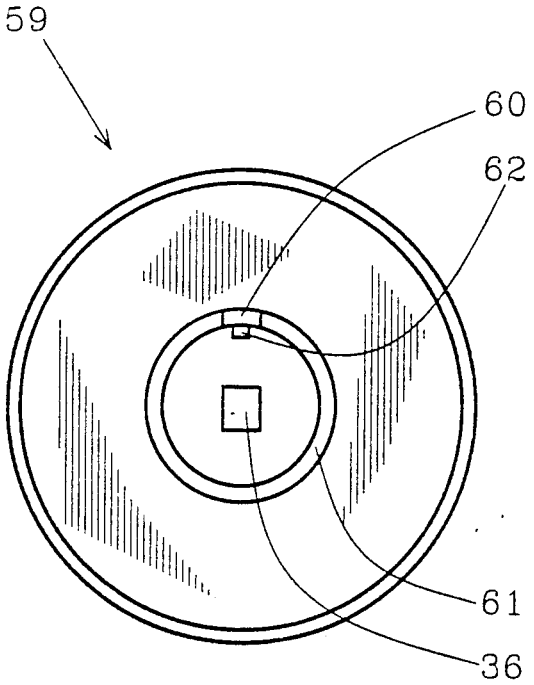
FIG. 20 is an inside view of a door handle with lock cylinder removed for a door lock of a variety for which double-ward-cut bypass keys are used.
Figure 21:
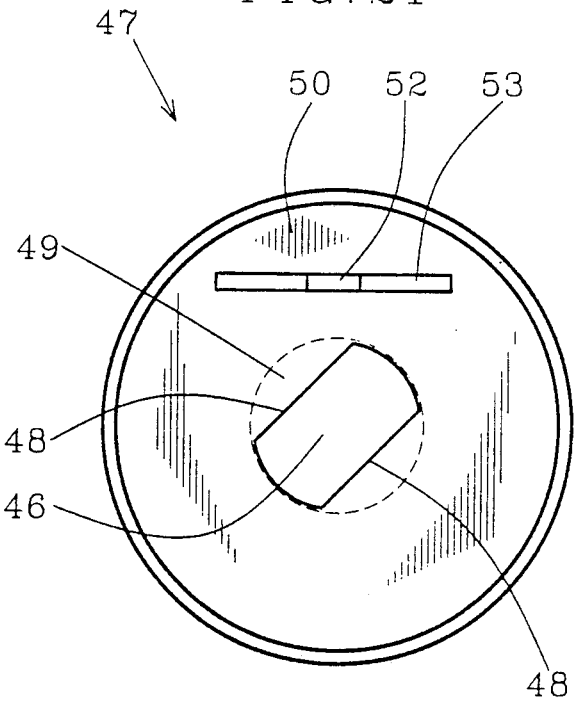
FIG. 21 is an inside view of a door handle with lock cylinder removed for a door lock of a variety for which single-ward-cut bypass keys are used.

Referring to FIGS. 19 and 20, an assembled door lock 54 in door 55 is provided with an inside handle 56 and an outside handle 57. A keyless lock mechanism often referred to as a night lock 58, is provided at the inside handle 56 while lock cylinder assembly 28 or 43 are operable with suitable conventional key at the outside handle 57. The night lock operates the tailpiece 36 in ways not a factor in relation to this invention. However, the existence and operation of the tailpiece 36 in ways not intended by its designers allow it to be used for assembling and disassembling either the lock cylinder assemblies 28 or 43 without removing them from the door with this invention.

The night lock can be a center-lug type or a door-handle type. A key-lockable inside lock with components operating in a similar manner in relationship to this bypass key system also can be employed within the scope of this invention.

It is emphasized that it is the bypass key system, not the lock or features of the lock that comprise this invention. Reference to the lock components are only incidental to describing the invention. This invention is made to service whatever type of lock from which a lock cylinder can be removed or installed in by extension of the key system through which the keyway to operate a lock-cylinder attachment means and locking mechanism.

In FIG. 20, a double-ward-cut door handle 59 is provided with a cylinder-housing channel 60 in door-lock sleeve 61 instead of the housing guide 53 and the lock base 50 in the single-ward-cut door handle 47. Arresting of transverse motion of the lock cylinder assembly 28 is achieved with the cylinder-housing channel 60 in a similar manner to that with which it is achieved with the housing guide 53.

Referring to FIGS. 20, 13 and 14, a cylinder assembly catch 62 at an inside wall of door-lock sleeve 61 is extended into a matching groove, channel or other matching attachment member such as a stop washer 63. Either attachment means can have an engagement path such as cylinder stop piece 34 and be operable by this key system. The handle tailpiece 36 extended through the center of the door handle can be a variety of angular shapes which match the cylinder stop aperture 25.

Change in the lock involving plug length, keyway width, keyway form, distance of locking components requiring ward cuts from keyway entry face, number of lock obstructions requiring ward cuts and other modifications of locks resulting in matching bypass-key-system modifications are anticipated and foreseeable within this invention.

All modifications, alternations, applications, forms and designs of this invention foreseeable from description in the following claims in light of the above specification and drawings are included in this invention, along with reserved, or restricted, or so called "high security" form types of locks.

I claim:

1. A lock-service bypass-key system comprising:

a control key blank having a key blade sized and shaped to fit inside of the keyway of the select lock cylinder and extended at least the length of the lock cylinder from an entry point of a keyway in the lock cylinder to a terminal end of a lock-cylinder attachment section of the lock cylinder and having a key-blade top profile made to operate a select lock cylinder and a double ward-cut step profile in a key-blade bottom sized and shaped to allow passage of a control-key tip into the lock-cylinder attachment section and through a lock-attachment aperture in the lock-cylinder attachment section; and a bypass key formable from the control key blank having a key blade sized and shaped to fit inside of a keyway of a select lock cylinder and extended at least the length of the lock cylinder from an entry point of a keyway to a terminal end of a lock-cylinder attachment section in the lock cylinder with a key-blade top low enough to pass under spring-loaded tumblers of the lock cylinder and having a double ward-cut step profile in a key-blade bottom sized and shaped to allow passage of a bypass-key tip into the lock-cylinder attachment section and through a lock-attachment aperture in the lock-cylinder attachment section.

2. A lock-service bypass-key system according to claim 1 and further comprising:

a control bypass key blank having a key blade sized and shaped to fit inside of the keyway of the select lock cylinder and extended at least the length of the lock cylinder from an entry point of a keyway in the lock cylinder to a terminal end of a lock-ring section of the lock cylinder and having a key-blade top cutable to operate a select lock cylinder and a single ward-cut step profile in a key-blade bottom sized and shaped to allow passage of a control-key tip into the lock-ring section and through a lock-shaft aperture in the lock-ring section; and a bypass key formable from a control key blank having a key blade sized and shaped to fit inside of a keyway of a select lock cylinder and extended at least the length of the lock cylinder from an entry point of a keyway to a terminal end of a lock-ring section in the lock cylinder with a key-blade top low enough to pass under spring-loaded tumblers of the lock cylinder and having a single ward-cut step profile in a key-blade bottom sized and shaped to allow passage of a bypass-key tip into the lock-ring section and through a lock-shaft aperture in the lock-ring section.

3. In a lock-service bypass-key system according to claim 1, a bypass key having:

a key blade sized and shaped to fit inside of a keyway of a select lock cylinder;

a length of the key blade from a shoulder section of a key bow to a blade tip that is at least equal to the distance from a key-entry face of the lock cylinder to a terminal end of a lock-ring section at an opposite end of the lock cylinder from the key-entry face of the lock cylinder;

a flat blade top parallel to a blade bottom and having a height from a blade bottom that is selectively less than height of major cross sections of fully-extended tumblers of the lock cylinder above a bottom of a keyway in the lock cylinder;

a base ward step cut at a distance from the shoulder section that is within a distance from the key-entry face to a base of the lock-ring section of a lock plug and selectively greater in depth than a distance from the bottom of the keyway to an inside surface of a lock-plug retainer at a base of a lock-ring-section of the lock plug;

a tip ward step cut at a distance from the base ward step cut that is selectively less that a distance from the base of the lock-ring section to a lock-shaft ring; and a lock-shaft displacement tip extended from the tip ward step cut to form a blade tip of the bypass key.

4. In a lock-service bypass-key system according to claim 1, a bypass key as described further in claim 3 wherein the lock-shaft displacement tip is extended at a select angle upwardly from the tip ward step cut.

5. In a lock-service by-pass key system according to claim 1, a bypass key as described further in claim 3 and further comprising:

a tumbler-raiser peak on top of the lock-shaft displacement tip sized and shaped with a leading edge slanted to form an incline plane at a leading edge for raising lock tumblers in the lock cylinder by exertion of inward pressure on the bypass key and a trailing edge slanted to form an incline plane to raise the tumblers by exertion of outward pressure on the bypass key.

6. In a lock-service bypass-key system according to claim 1, a bypass-key blank having:

a key blade sized and shaped to fit inside of a keyway of a select lock-cylinder;

a length of the key blade from a shoulder section of a key bow to a blade tip that is at least equal to a distance from a key-entry face of the lock cylinder to a terminal end of a lock-ring section of the lock cylinder at an opposite end of the lock cylinder from the key-entry face of the lock cylinder;

a blade top parallel to a blade bottom and having a height from a blade bottom that is selectively less than the distance of lock-cylinder tumblers of the lock cylinder in a retracted position to a bottom of a keyway in the lock cylinder;

a base ward step cut at a distance from the shoulder section that is within a distance from the key-entry face to a base of the lock-ring section of a lock plug and selectively greater in depth than a distance from the bottom of the keyway to an inside surface of a lock-plug retainer at a base of a lock-ring-section of the lock plug;

a tip ward step cut at a distance from the base ward step cut that is selectively less than a distance from the base of the lock ring section to a lock-shaft ring; and a lock-shaft displacement tip extended from the tip ward step cut to form a blade tip of the bypass key.

7. In a lock-service bypass-key system according to claim 1, a bypass-key blank as described further in claim 6 and further comprising:

a leading edge of the tip that is sloped selectively to provide an incline to lift extended tumblers in the lock cylinder with inward travel of the bypass key blank in the lock cylinder.

8. In a lock-service bypass-key system according to claim 1, a control key having:

a key blade sized and shaped to fit inside of a keyway of a select lock cylinder;

a length of the key blade from a shoulder section of a key bow to a blade tip that is at least equal to the distance from a key-entry face of the lock cylinder to a terminal end of a lock-ring section at an opposite end of the lock cylinder from the key-entry face of the lock cylinder;

a blade top having select lock-operative profile section between a shoulder section and a selectively-extended tip section;

a base ward step cut at a distance from the shoulder section that is within a distance from the key-entry face to a base of the lock-ring section of a lock plug and selectively greater in depth than a distance from the bottom of the keyway to an inside surface of a lock-plug retainer at a base of a lock-ring-section of the lock plug;

a tip ward step cut at a distance from the base ward step cut that is selectively less than a distance from the base of the lock-ring section to a lock-shaft ring; and a lock-shaft displacement tip extended from the tip ward step cut to form the blade tip of the bypass key.

9. In a lock-service bypass-key system according to claim 1, a control key as described in claim 7 and further comprising:

a leading edge of the blade tip that is sloped selectively to provide an incline to lift extended tumblers of the lock cylinder with inward travel of the control key in the lock cylinder.

10. A lock-service bypass-key system according to claim 1 wherein the key-blade top of the control key is cut to operate a plurality of select lock cylinders.

11. A lock-service bypass key system according to claim 1 wherein dimensions of the control key blank in inches within a tolerance 0.002 of an inch comprise a blade height from bottom to top of 0.335, a height for cut section of 0.170, a blade length from shoulder section to blade tip of 1.420, a single ward cut 0.510 long and 0.165 deep, a length of blade from shoulder to ward cut of 0.910, and a blade thickness of 0.080.

12. A lock-service bypass-key system according to claim 1 wherein dimensions of the control key blank in inches within a tolerance of 0.002 of an inch comprise a blade height from bottom to top of 0.335, a height for cut section of 0.165, a blade length from shoulder to blade tip of 1.547, a base ward cut 0.344 long and 0.050 deep, a tip ward cut 0.250 long and 0.120 deep, a length of blade from shoulder to base ward cut of 0.953, and a blade thickness of 0.080.

13. A method for using a bypass key in relation to construction and utilization of a control key to service a select door lock without removing the lock from a door in which it is installed when the lock has been locked and a key for the lock is not available and comprising the following steps:

a) picking the lock by raising tumblers of a lock cylinder of the lock with a pick tool having a suitable small peak with suitably inclined leading and trailing edges on an insertable end of a suitably thin pick-tool blade;

b) with the pick tool remaining in the lock cylinder, rotating the lock cylinder clockwise to approximately 4 o'clock position with the pick-tool blade;

c) removing the pick tool from the lock cylinder;

d) inserting the control bypass key approximately one-half of its blade length into the lock cylinder;

e) with the bypass key, turning the lock cylinder slowly back counterclockwise to approximately a 1 o'clock position;

f) inserting the bypass key the remainder of the way into the lock cylinder while assuring by sensing a spring reaction that the tip of the bypass key contacts a spring-loaded tail piece and pushes it from a lock-shaft ring in a lock-ring-section end of the lock cylinder by inward movement of the bypass key;

g) turning the bypass key quickly clockwise from the 1 o'clock position to a 6 o'clock position;

h) removing the bypass key;

i) reinserting the pick tool;

j) extracting the lock cylinder by pulling the pick tool when tumblers are engaged selectively with the peak of the pick tool and the lock cylinder is disengaged from a lock handle;

k) cutting a top profile of a control bypass key from a key blank that is sized and shaped for entry into the lock cylinder and that is as long as the lock cylinder to operate a change lock cylinder with no deeper than fifth-level cuts and with a full-length blade tip remaining on the control key;

l) master-key matching the control key to a change key for the change lock cylinder;

m) inserting the control key into the change lock cylinder;

n) rotating the change lock cylinder clockwise 180 degrees from a 12 o'clock position to a 6 o'clock position with the control key;

o) with the control key remaining in the change lock cylinder, inserting the change lock into the lock handle; and p) while holding the change lock in the lock handle, rotating the control key 180 degrees to the left to cause the change lock cylinder to be engaged and ready for use with the change key, with an optional master key and with the control key for future servicing of the change lock.

14. A method according to claim 13 wherein the bypass key is provided with a tumbler-raiser peak on top of the lock-shaft displacement tip sized and shaped with a leading edge slanted to form an incline plane at a leading edge for raising lock tumblers in the lock cylinder by exertion of inward pressure on the bypass key and a trailing edge slanted to form an incline plane to raise the tumblers by exertion of outward pressure on the bypass key when the bypass key is removed from the lock cylinder; wherein steps h) and i) are omitted; and the lock cylinder is extracted with the bypass key in step j).

15. A method for using a control key to service a select lock without removing the lock from a door when the lock has been locked, when a key for the lock is not available, and when a control key is available for the lock; and comprising the following steps:

a) inserting the control key all of the way to its shoulders into the locked lock cylinder;

b) rotating the control bypass key clockwise 180 degrees to a 6 o'clock position to disengage the lock cylinder from the lock handle;

c) disengaging the lock cylinder by using the control key as a handle to hold the lock cylinder and remove the lock cylinder when it flips loose from the door handle;

d) if the lock cylinder does not come loose from the door handle at the above step as a result of internal misalignment, rotating the key slightly in both directions of rotation to cause the lock cylinder to flip loose;

e) unlocking the door by inserting an object such as the control key into door handle from which the lock cylinder has been removed and pushing the door-lock slightly inward with the inserted object and then remove the inserted object;

f) making such changes of keys and lock cylinders as desired for operating the lock in the future;

g) inserting the control key its full length into a change lock cylinder;

h) with a tumbler section of the lock cylinder held in a vertical position above the lock cylinder, inserting the change lock cylinder into the door handle;

i) while holding the change lock cylinder as far in the door handle as possible with light finger pressure, rotating the control key clockwise past the six o'clock position to approximately and 8 o'clock position until it engages the lock in an installed position in the door handle;

j) rotating the key counterclockwise to a 12 o'clock position; and k) removing the control key with a change lock cylinder installed.

16. A method for using a control key to service a select lock without removing the lock from a door when a key to the lock is available comprising the following steps:

a) copying a profile of the key to the lock onto a bypass key blank that is sized and shaped for entry into a keyway of the lock and that has a blade tip with a length sufficient to extend from the profile of the key to a terminal end of the lock cylinder;

b) milling ward step cuts in the bottom of the tip of the blank as necessary for entry of the tip into a lock-ring section of the lock cylinder and through a lock-shaft ring in the lock-ring section of the lock cylinder to make the control key blank into a control key;

c) inserting the control key into the locked lock cylinder with the copied profile in position to operate the lock;

d) rotating the control key clockwise 180 degrees to a 6 o'clock position to disengage the lock cylinder from the lock handle;

e) disengaging the lock cylinder by using the control key as a handle to hold the lock cylinder and remove the lock cylinder when it comes loose from the door handle;

f) if the lock cylinder does not come loose from the door handle at the above step as a result of internal misalignment, rotating the key slightly in both directions of rotation to cause lock cylinder to come loose; and g) making such changes of keys and lock cylinders as desired with the aid of the control key for operating the lock in the future.

* * * * *